United States Patent [19]

Matsuda et al.

[11] Patent Number: 4,634,113

[45] Date of Patent: Jan. 6, 1987

[54] SHEET WINDING AND DISCHARGING DEVICE

[75] Inventors: Hideo Matsuda, Nara; Shinitiro Hiraoka, Yamatotakada, both of Japan

[73] Assignee: Sharp Kabushiki Kaisha, Osaka, Japan

[21] Appl. No.: 800,306

[22] Filed: Nov. 21, 1985

[30] Foreign Application Priority Data

| | | | |
|---|---|---|---|
| Nov. 22, 1984 | [JP] | Japan | 59-248317 |
| Nov. 22, 1984 | [JP] | Japan | 59-248318 |
| Dec. 7, 1984 | [JP] | Japan | 59-259619 |

[51] Int. Cl.[4] ..... B65H 7/14

[52] U.S. Cl. ..... 271/259; 271/265; 271/277

[58] Field of Search ..... 271/277, 258, 259, 265, 271/82

[56] References Cited

U.S. PATENT DOCUMENTS

| | | | |
|---|---|---|---|
| 3,790,159 | 2/1974 | Hatzmann | 271/277 X |
| 3,955,812 | 5/1976 | Suda | 271/265 X |
| 4,517,575 | 5/1985 | Kakimoto | 271/277 X |

*Primary Examiner*—Richard A. Schacher

*Attorney, Agent, or Firm*—Birch, Stewart, Kolasch & Birch

[57] ABSTRACT

A sheet winding and discharging device which includes a drum rotatably mounted in the device for winding a sheet therearound, sheet feeding members for feeding the sheet to the drum, a pair of sheet detecting sensors for detecting the length of the sheet to be fed, a pair of claw members mounted on the drum for holding the sheet which is fed to the drum and control members for controlling the movement of the claw members, the control members having a function for discharging the sheet without winding it around the drum in case that the sheet has a length more than the predetermined length.

5 Claims, 10 Drawing Figures

SHEET WINDING AND DISCHARGING DEVICE

BACKGROUND OF THE INVENTION

The present invention generally relates to a sheet supplying or discharging arrangement and more particularly, to a sheet winding and discharging device provided with a pair of claw members at the periphery of a rotary drum so as to hold a sheet therebetween, and capable of automatically winding a sheet such as a paper sheet, film or the like around the rotary drum and discharging the sheet therefrom.

The sheet winding and discharging device as described above has been employed for an automatic paper feeding and discharging device in a telecopier, copying machine or the like.

In this kind of device, it is generally impossible to use a sheet longer than a predetermined length without changing the drum diameter. Therefore, there has been such a disadvantage that when the sheet which is longer than the predetermined length is erroneously wound around the drum, a sheet discharging process can not be regularly carried out even if a sheet discharging signal is generated, due to the fact that the sheet is doubly wound around the drum.

Furthermore, there has also been such a drawback that the above described device tends to be large in size, since the mechanism thereof is extremely complicated. Accordingly, the inventors of the present application have proposed a sheet winding and discharging device in Japanese Patent application No. 59-75543 which is assigned to the same assignee as the present application and discloses the above described device provided with a pair of claw members disposed at the periphery of the rotary drum for automatically winding the sheet around the drum and discharging the sheet therefrom through the opening and shutting of the claw members. The sheet winding and discharging device as described above has such an advantage that a small-sized device can be obtained owing to its extremely simple construction.

However, one of the claw members for holding the sheet therebetween has a width of approximately the same as that of the drum and the other member is also broad enough and moreover, neither thereof has any elasticity. Therefore, it has been a problem that each of the claw members has to be mounted on the drum with extremely high accuracy so as to steadily hold the sheet therebetween under relatively uniform pressure.

In addition, as shown in FIG. 1, since the distal end surface of a first claw member 5 is formed at right angles relative to the peripheral surface of the drum 2, the light emitted from the light source 7*a* is intercepted by the distal end portion of the first claw member 5 as indicated by dotted lines in FIG. 1 and a portion of the sheet 1 immediately below the distal end portion of the first claw member 5 is underexposed. As a result, the above described phenomenon has caused such a problem that copying noise, like a black streak, appears on a copy paper during the copying operation.

SUMMARY OF THE INVENTION

Accordingly, an essential object of the present invention is to provide an improved sheet winding and discharging device which is intended to substantially eliminate a trouble inherent in the device of this kind by discharging a sheet immediately without winding it around a drum, when the sheet longer than a predetermined length is erroneously inserted into the device.

Another object of the present invention is to provide a sheet winding and discharging device of the above described type with high reliability, which is capable of steadily holding the sheet between a pair of claw members disposed on the drum without necessity for increasing the accuracy in installation of the claw members.

A further object of the present invention is to provide a sheet winding and discharging device of the above described type, by which copying functions at high quality can be obtained, with copying noise being prevented from forming below a distal end surface of a first claw member obliquely.

In accomplishing these and other objects, according to one preferred embodiment of the present invention, there is provided a sheet winding and discharging device which includes a drum rotatably mounted in the device for winding a sheet therearound, a sheet feeding means for feeding the sheet to the drum, a sheet detecting means for detecting the length of the sheet to be fed, a sheet holding means mounted on the drum for holding the sheet which is fed to the drum and a control means for controlling the movement of the sheet holding means, the control means having a function for discharging the sheet without winding it around the drum in case that the sheet has a length more than the predetermined length.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
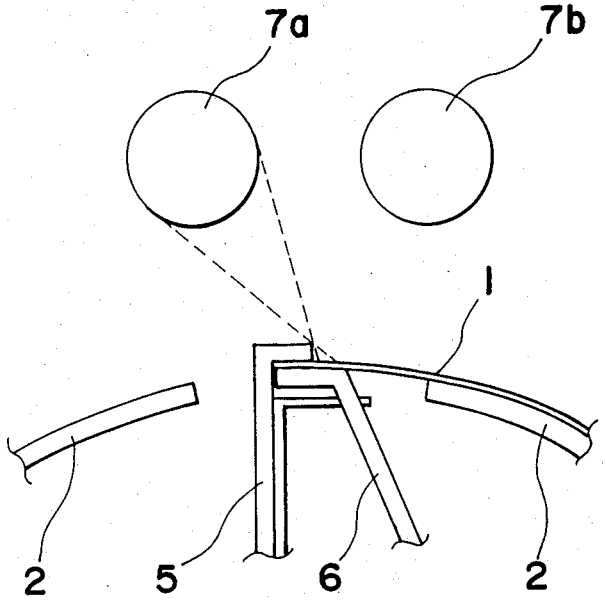
FIG. 1 is a main portion of a rotary drum of a sheet winding and discharging device on an enlarged scale, as previously proposed by the present inventors.

Before the description of the present invention proceeds, it is to be noted that like parts are designated by like reference numerals throughout the accompanying drawings.

Figure 2:
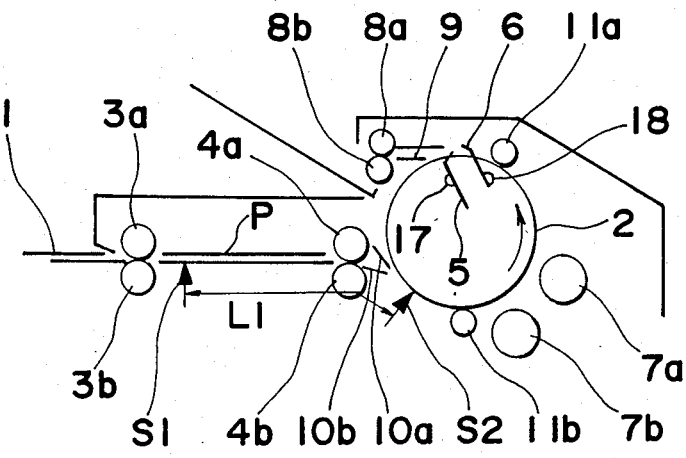
FIG. 2 is a schematic view of the sheet winding and discharging device according to one preferred embodiment of the present invention which is employed for a document feeding device of a copying machine.

Referring first to FIG. 2, there is illustrated a schematic diagram of a document feeding device of a copying machine which employs a sheet winding and discharging device according to one preferred embodiment of the present invention.

In FIG. 2, a sheet 1 is fed, through a pair of sheet feeding rollers 3*a*, 3*b*, a pair of timing rollers 4a, 4b and a pair of sheet feeding guides 10*a*, 10*b*, to a sheet holding portion having a first claw member 5 and a second claw member 6 on a drum 2. The sheet 1 is exposed to light by a pair of light sources 7*a* and 7*b* of an exposing portion, with a leading end portion thereof being nipped between both of the claw members 5 and 6 so that the sheet 1 is wound around the drum 2. Then, upon rotation of the drum 2 by predetermined times for repeated exposure of the sheet 1, it is released from its retention on the drum 2 and thereafter, it is stripped therefrom by the second claw member 6 so as to be discharged from a pair of sheet discharging rollers 8*a* and 8*b* through a sheet discharging guide 9.

Meanwhile, there are provided sheet detecting sensors S1 and S2 for detecting the length of the sheet 1, and the sensor S1 is arranged on a sheet passage P and the sensor S2 is provided between the timing rollers 4*a*, 4*b* and a sheet press roller 11*b*. In addition, it is so designed that the distance L1 between both of the sensors S1 and S2 is normally determined to be less than a length obtained by subtracting a rotational circumferential length required for the sheet discharging process from the circumferential length of the drum 2. In this case, the sheet discharging process is carried out within the same rotational period as the sheet feeding process. Although it is sufficient for the distance L1 to be determined less than the maximum circumferential length of the drum 2, on the assumption that the distance L1 is determined to be slightly less than the above described circumferential length, the sheet discharging process is carried out in the rotational period next to the period wherein the sheet feeding process has been carried out.

Figure 3:
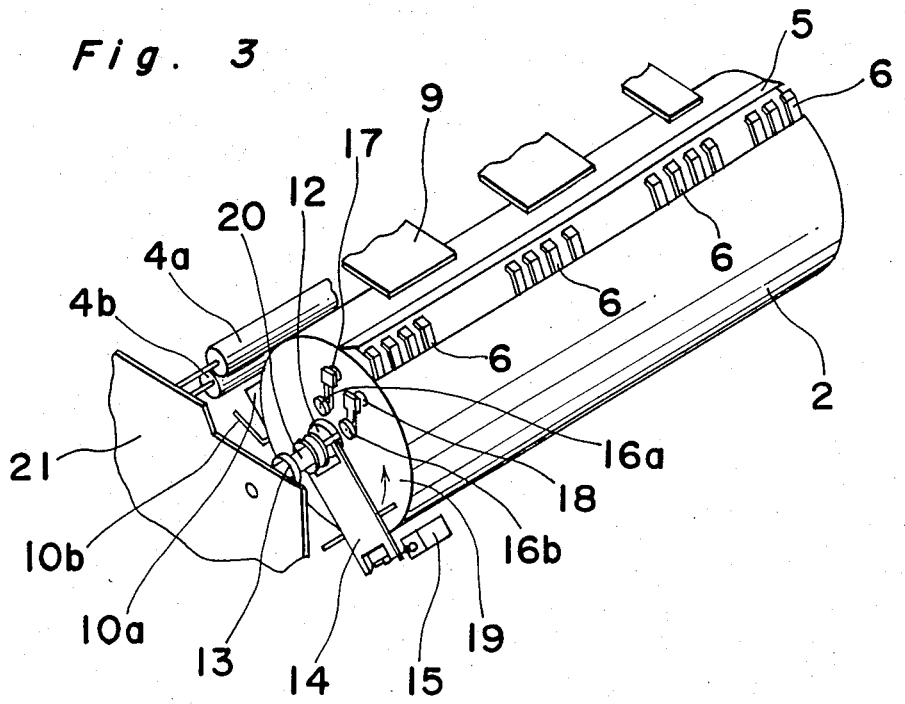
FIG. 3 is a detailed perspective view of the drum employed in the device of FIG. 2.
Figure 4:
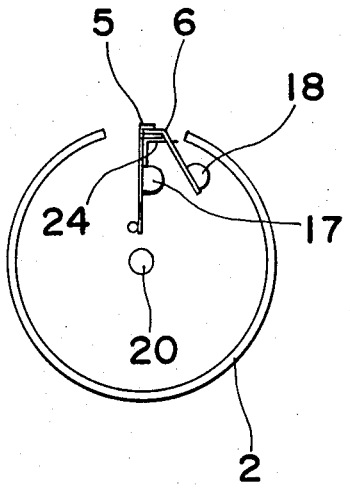
FIG. 4 is a cross sectional view of the drum of FIG. 3.
Figure 5A:
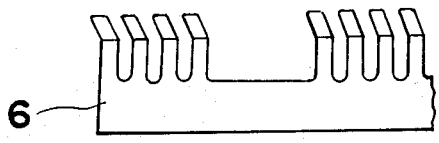
FIG. 5*a* is a front elevational view showing on an enlarged scale, a second claw member of the sheet winding and discharging device according to one preferred embodiment of the present invention.

Subsequently, referring to FIGS. 3 and 4, the construction of the sheet winding and discharing device will be described more in detail hereinafter. The claw members 5 and 6 are mounted on shafts 17 and 18 respectively, which are supported on both of side plates 19 disposed at opposite ends of the drum 2. The first claw member 5 is simply formed by a plate bent in L-shaped state, with the plate having approximately the same width as that of the drum 2. On the contrary, as shown in FIG. 5*a*, the second claw member 6 is formed by a thin spring plate which is bent at an obtuse angle and the distal end portion thereof for holding the sheet together with the first claw member 5 is divided into a plurality of pieces like teeth of a comb. Furthermore, it is so designed that each piece of the second claw member 6 is comparatively narrow so as to have a sufficient elasticity.

Meanwhile, a drum shaft 20 for supporting and rotating the drum 2, is provided with a cam 12 mounted thereon for axial movement therealong, but non-rotatably together therewith and a compression coil spring 13 for pressing the cam 12 toward the side plate 19 of the drum 2.

A pair of cam followers 16*a* and 16*b* are respectively so connected to the above described shafts 17 and 18 that upon rotation of the drum 2 in a direction indicated by an arrow, the cam followers 16*a* and 16*b* come into contact with the corresponding portions 12*a* and 12*b* of the cam 12 respectively so as to rotate the shafts 17 and 18 at predetermined angles. Opening and shutting of the first and the second claw members 5 and 6 follow the above described rotation of the shafts 17 and 18.

A solenoid 15 is provided for moving a movable plate 14 in the axial direction of the drum shaft 20 so as to shift the cam 12. That is, the above described mechanism is for the purpose of releasing the cam 12 from its engagement with the cam follower 16*a* or 16*b* by shifting the cam 12 toward a frame 21 of the device and thereby, the drum 2 around which the sheet 1 is wound is capable of rotating predetermined times without discharging the sheet 1.

In the device according to the present invention, the sheet 1 is led to the timing rollers 4*a* and 4*b* by the sheet feeding rollers 3*a* and 3*b*, and is brought to a halt for a while. Thereafter, when the sheet holding portion comprising the first and the second claw members 5 and 6 on the drum 2 rotates to the predetermined position whereat the distal end portion of the first claw member 5 faces that of the second claw member 6 at a certain distance, the sheet 1 in a stand-by state is fed again at a speed faster than the rotating speed of the drum 2 so as to be pushed in between the first claw member 5 and a guide 24. Subsequently, one of the cam followers 16*b* is disengaged from the cam 12*b* and the leading end portion of the sheet 1 is pushed toward the first claw member 5 by the second claw member 6 so as to be held therebetween. At this moment, even if the distal end portions of both of the claw members 5 and 6 facing each other are arranged not in parallel to each other but in an inclined state to some extent, the sheet 1 can be securely held by both of the claw members 5 and 6 owing to the elasticity of the second claw member 6 having its distal end portion like the teeth of a comb as shown in FIG. 5*a*. According to the above described construction, the sheet 1 can be steadily held between both of the claw members 5 and 6 under relatively uniform pressure thereby without increasing installation accuracy of the claw members 5 and 6 so as to be wound around the drum 2.

Figure 5B:
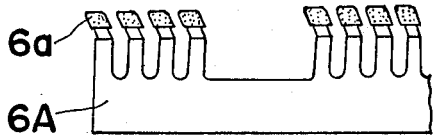
FIGS. 5*b* and 5*c* are views of second claw members similar to FIG. 5*a*, which particularly show modifications thereof.

It is to be noted here that as shown in FIG. 5*b*, the distal end portion of the second claw member 6A like the teeth of a comb may be so modified as to be molded in rubber 6*a* so that the holding force for the sheet 1 can be increased.

Figure 5C:
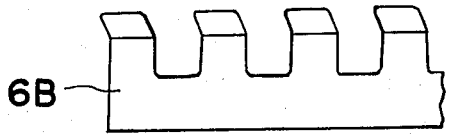

It may be also so modified that as shown in FIG. 5*c*, the width of each tooth of the second claw member 6B and the interval between adjacent teeth thereof are made slightly wider than those of the foregoing embodiment as shown in FIG. 5*a* and the above stated modification as shown in FIG. 5*b*, so as to obtain an increased holding force for the sheet 1.

Figure 6:
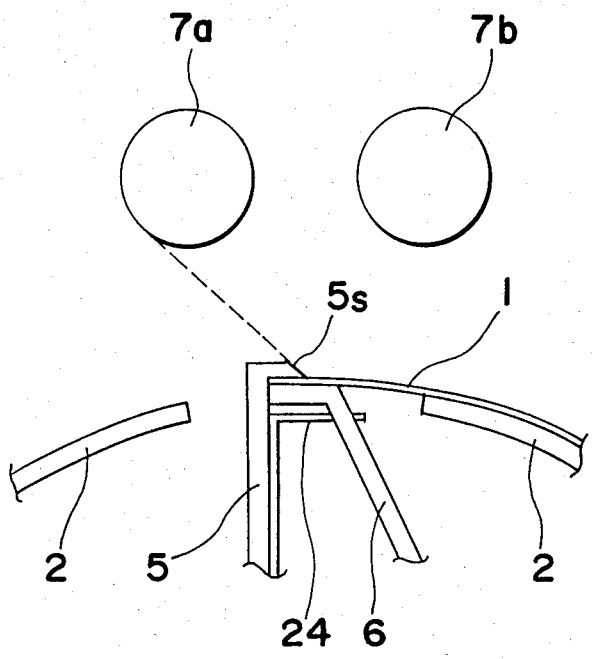
FIG. 6 is a main portion of the rotary drum on an enlarged scale, similar to that in FIG. 1, according to one preferred embodiment of the present invention.

Although, the sheet 1 is, thus, exposed by the light sources 7*a* and 7*b* by turns with the rotation of the drum 2, since the distal end surface 5s of the first claw member 5 is obliquely formed so that the light from the light source 7*a* is not intercepted by an edge thereof as shown in FIG. 6, the portion of the sheet 1 adjacent to the first claw member 5 is sufficiently exposed as well as the other portion thereof. Accordingly, although a light streak of the copying noise has appeared at one end of the sheet 1 under the influence of the claw member 5 so far, the copying noise can be extremely easily prevented at low cost according to the present invention.

It should be noted that although the distal end surface 5s of the first claw member 5 is obliquely formed in the foregoing embodiment, approximately the same effect can be obtained by forming at least the distal end portion of the claw member 5 of a transparent material such as resin.

Figure 7:
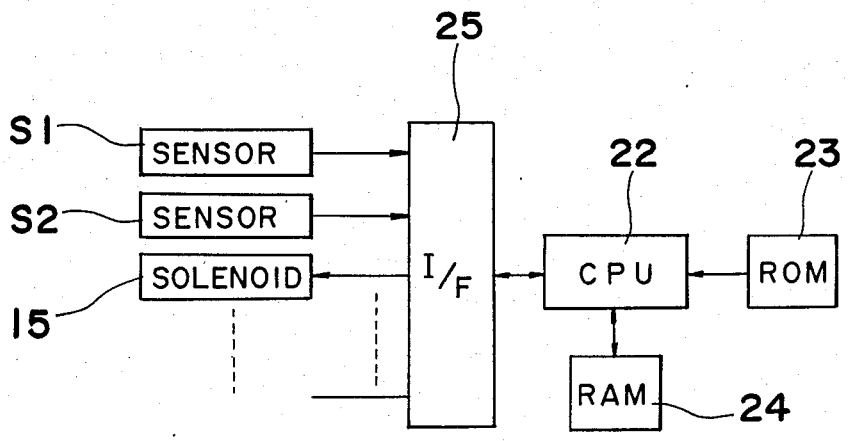
FIG. 7 is a block diagram of a control circuit for the sheet winding and discharging device according to one preferred embodiment of the present invention.

In FIG. 7, there is shown a control circuit according to one preferred embodiment of the present invention, which includes a CPU (central processing unit) 22 coupled to a ROM (read only memory) 23 memorizing a control program and the like, a RAM (random access memory) 24 which is used as a working memory and an interface 25 which is applied with signals from a plurality of sensors such as the sheet detecting sensors S1, S2, etc. and outputs signals to one or more actuators such as the solenoid 15, etc.

Referring now to a flow-chart of FIG. 8, specific functionings of the present invention will be described hereinafter.

Figure 8:
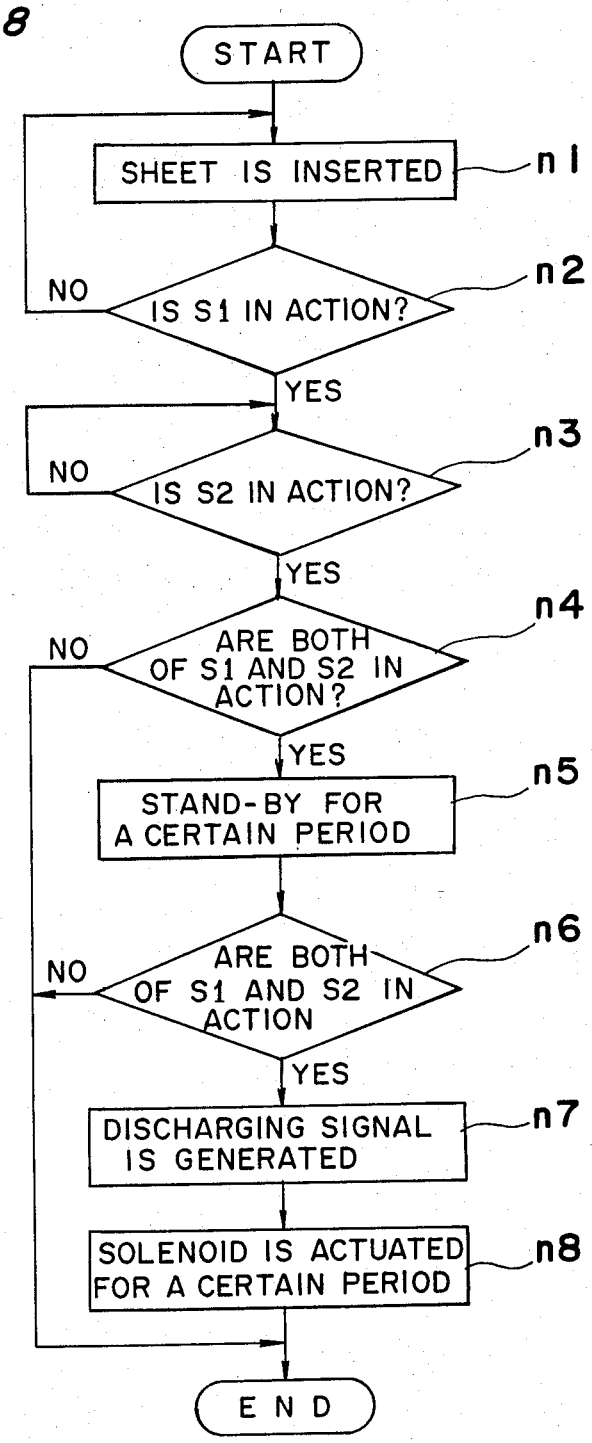
FIG. 8 is a flow-chart for explaining specific functions of the sheet winding and discharing device according to one preferred embodiment of the present invention.

In FIG. 8, when the sheet 1 is inserted into the device, it is judged whether or not the sheet detecting sensor S1 disposed on the passage P is in action at steps n1 and n2. If the sensor S1 is in action, it is judged at step n3 whether or not the other sensor S2 disposed between the timing rollers 4*a*, 4*b* and the sheet press roller 11*b* is in action. If the sensor S2 is in action, the procedure proceeds to step n4 whereat it is judged whether or not both of the sensors S1 and S2 are in action, that is, it is judged whether or not both thereof are detecting the sheet 1. If both of the sensors S1 and S2 are detecting the sheet 1, after the lapse of a certain period at step n5, it is judged again at step n6 whether or not both of the sensors S1 and S2 are in action. If both of the sensors S1 and S2 are still in action, that is, both thereof are detecting the sheet 1, a sheet discharging signal is generated, at step n7, from the CPU 22 for actuating the solenoid 15 for a certain period at step n8, so as to discharge the sheet 1 which is inserted within the same rotational period of the drum 2.

In the above described manner, when the sheet 1 is fed by means of the sheet feeding rollers 3*a*, 3*b* and the timing rollers 4*a*, 4*b*, it is judged that the sheet 1 is longer or shorter than the predetermined length according to the state of both of the sensors S1 and S2. In other words, when only the sensor S2 is in action at step n4, an ordinary process is carried out through the judgement wherein the sheet 1 shorter than the predetermined length has been inserted. At the same step n4, when both of the sensors S1 and S2 are in action, it is judged whether the same state thereof continues or not for a certain period and if the state is kept unchanged for a certain period, the sheet 1 is immediately discharged without being wound around the drum 2 in accordance with the judgement wherein the sheet 1 longer than the predetermined length has been inserted.

As is clear from the foregoing description, according to the arrangement of the present invention as explained so far, there are provided such advantages that the sheet winding and discharging device with high reliability can be obtained at reduced cost, with the time required for assembling work thereof being extremely reduced.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A sheet winding and discharging device which comprises:

a drum rotatably mounted in the device for winding a sheet therearound;

a sheet feeding means for feeding the sheet to the drum;

a sheet detecting means for detecting the length of the sheet to be fed;

a sheet holding means mounted on the drum for holding the sheet which is fed to the drum; and a control means for controlling the movement of the sheet holding means, said control means having a function for discharging the sheet without winding it around the drum in case that the sheet has a length more than the predetermined length.

2. A sheet winding and discharging device as claimed in claim 1, wherein said sheet holding means is formed of a first claw member disposed at the periphery of the drum for positioning the leading end of the sheet, and a second claw member for holding the leading end portion of the sheet together with said first claw member and for stripping said leading end portion of the sheet wound around the drum from the peripheral surface thereof, said second claw member being made of an elastic material and formed like teeth of a comb at the distal end portion thereof.

3. A sheet winding and discharging device as claimed in claim 2, wherein the distal end portion of said second claw member is molded in soft material such as rubber and the like.

4. A sheet winding and discharging device as claimed in claim 2, wherein the distal end surface of said first claw member is obliquely formed.

5. A sheet winding and discharging device as claimed in claim 1, wherein said control means comprises a cam means, a movable plate and one or more actuators, for operating a pair of said claw members properly in compliance with rotation of the drum.

* * * * *